United States Patent [19]

St. Onge

[11] Patent Number: 4,861,449

[45] Date of Patent: Aug. 29, 1989

[54] COMPOSITE ANODE

[76] Inventor: Hank St. Onge, 226 Catalina Dr., Scarborough Ontario, Canada

[21] Appl. No.: 153,789

[22] Filed: Feb. 8, 1988

[51] Int. Cl.[4] ..... C23F 13/00

[52] U.S. Cl. ..... 204/197; 204/148; 204/272; 204/280; 204/292; 204/294

[58] Field of Search ..... 204/147, 196, 272, 280, 204/291, 292, 294, 101, 148, 197, 268, 254, 290 R

[56] References Cited

U.S. PATENT DOCUMENTS 3,994,795 11/1976 Kurr ..... 204/280

4,427,517 1/1984 Lau ..... 204/197

*Primary Examiner*—John F. Niebling

*Assistant Examiner*—Kathryn Gorgos

[57] ABSTRACT

The anode comprises a core of a metal having a negative potential relative to steel, and an adjacent electrode of a material having a positive potential relative to steel. The adjacent electrode has a first substrate generally facing the core and a second substrate in direct electrical communication with the first substrate end of a material having a negative potential relative to steel substantially shielded from the core by the first substrate. The anode includes a suitable porous material between the core and the electode which tends to retain water. The anode produces a potential voltage in the presence of an electrolyte between the core and electrode which is the collective effect of the material of the core and the materials of the electrode. Such an anode can produce a higher potential voltage than conventional sacrificial anodes and be designed for particular desired voltage potentials.

19 Claims, 2 Drawing Sheets

COMPOSITE ANODE

BACKGROUND OF THE INVENTION

The present invention relates to sacrificial anodes and in particular sacrificial anodes for use in providing cathodic protection of buried steel products.

Sacrificial anodes for the protection of buried steel or submerged steel products is well known. The most common sacrificial anodes are made of zinc or magnesium and an electrical connector serves to connect the anode with the steel to be protected. The soil environment and/or water provides an electrolyte between the product to be protected and the anode, thus completing the circuit and the anode is sacrificed in preference to the steel. This will continue until the anode is depleted and the expected life of the anode will be a function of at least the size of the product being protected and the environment in which it is placed. The voltage potential used to drive the circuit is primarily a function of the material of the anode and the product being protected.

In other cases, an implied current system can be used where power from an external source supplies the voltage potential between an electrode and the product to be protected and typically implied current systems operate with a voltage of about 3000 mv. The standard zinc anode has an output of about 500 mv negative with respect to steel, whereas magnesium anodes would produce about 800 mv relative to steel. The zinc anode is preferred due to its higher efficiency and longer expectant life; however in some environments, it is beneficial to use the higher output magnesium anode.

It is common with sacrificial anodes to encase them in a porous material which tends to retain water such as a gypsum bentonite mixture, and in other cases, this mixture is placed between the anode and the steel or iron article to be protected.

It would be desirable to be able to manufacture a sacrificial anode in accordance with a desired voltage potential with the anode custom designed to the application, and furthermore, it would be desirable to have a sacrificial anode where the output is substantially higher than the common zinc and magnesium sacrificial anodes now used.

SUMMARY OF THE INVENTION

A composite sacrificial anode according to the present invention comprises a core of a metal having a negative potential relative to steel and an adjacent electrode of a material having a positive potential relative to steel. This adjacent electrode has a first surface generally facing the core and a second surface in direct electrical communication of a material of a negative potential relative to steel substantially shielded from the core by the material having a positive potential relative to steel. The core includes means for securing an electrical lead thereto. The anode includes a suitable porous material between the core and the electrode which tends to retain water. The anode produces a potential voltage in the presence of an electrolyte between the core and the electrode which is the collective of the material of the core and the material of the electrodes. Such an anode has a higher potential than an anode of one of the materials alone.

According to an aspect of the invention, the composite sacrificial anode has an electrode formed like a ring about the core.

According to an aspect of the invention, the electrode is made up of a series of connected segments spaced about the core.

The composite sacrificial anode of the present application uses the water or soil environment to connect the core with the spaced electrode, and the materials of the core and the electrodes are selected to achieve a battery-like effect to increase the overall potential. The first material of the electrode substantially shields the second material from the core and additional electrodes can be spaced beyond the first electrode to further increase the potential of the anode. The ring-like orientation of the electrode about the core is desirable as the anode can be placed in close proximity to the article to be protected; however, other arrangements are possible. In a preferred form of the invention, the electrode or electrode segments are made of two plate-like members placed in back to back relationship with this back to back relationship providing the electrical connection therebetween.

BRIEF DESCRIPTION OF THE DRAWINGS

Preferred embodiments of the invention are shown in the drawings wherein.

DETAILED DESCRIPTION OF THE PREFERRED EMBODIMENTS

The potential voltages referred to below are the theoretical potentials and actual voltages will vary, perhaps as much as 300 milvolts, depending upon the configuration and resistances. Therefore, the potentials are provided as a guideline and are subject to variation.

Figure 1:
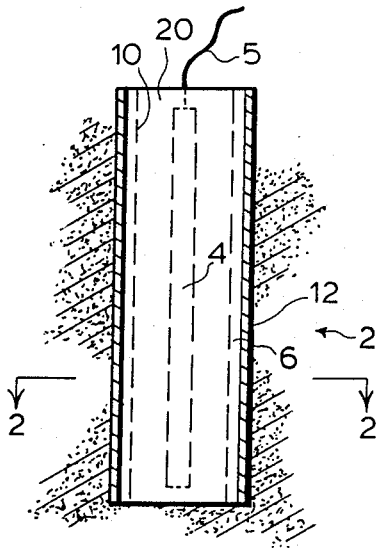
FIG. 1 is a cross-section of the composite sacrificial anode.
Figure 2:
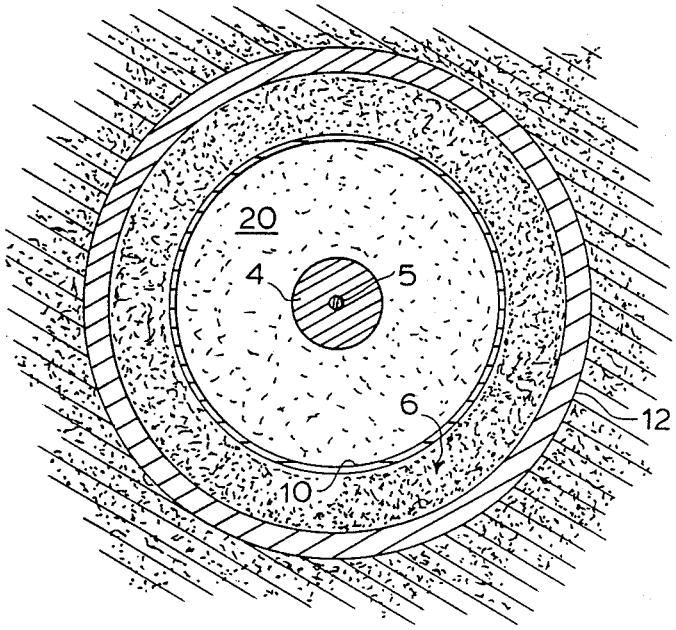
FIG. 2 is a sectional view taken along line A—A of FIG. 1.

The sacrificial anode generally shown as 2 includes a core 4 of a suitable material such as magnesium or zinc which will sacrifice in preference to iron or steel products when electrically connected thereto. Associated with core 4 is an adjacent electrode 6 which, as shown in FIG. 2, is a ring-like electrode made of two different materials. The first surface 10 faces the core, generally surrounds the core 4, and is preferably of a graphite material or graphite powder. The second surface 12 of the electrode 6 is shielded from the core by the first surface 10 and is preferably of a material the same as the core. Intermediate the adjacent electrode 6 and the core 4 is a mixture of gypsum and bentonite generally shown as 20 which is porous and tends to retain water. This retained water will act as an electrolyte connecting the core to the adjacent electrode. The core 4 is connected to a article to be protected by a connector 5.

The sacrificial anode , when placed in close proximity to a steel tank, for example with the core of the anode directly electrically connected with a steel tank, will produce a voltage potential greater than that of the core alone. If the core is made of zinc and the first surface of the adjacent electrode is made of graphite and the second surface of the adjacent electrode is a zinc casing, a voltage is generated which is a result of the potential between the zinc core to graphite of being 1500 mv and the relation of the graphite to the zinc outer surface reversing this to −1500 mv. The zinc outer casing to the steel pipe or article to be protected would be approximately +900 mv. Thus, the output of the anode is approximately 1500 mv when the various materials are graphite and zinc. If magnesium was used, the potentials would be different, but the same principles would apply. Electrode 6 is porous or has means for allowing water to come into contact with the gypsum bentonite mixture 20 and form an electrolyte connecting the various surfaces.

Figure 3:
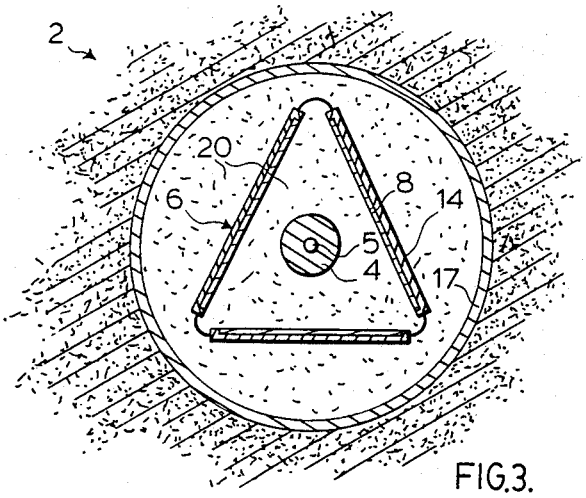
FIG. 3 is a cross-sectional view of a modified composite sacrificial anode.

The anode of FIG. 3 again uses a zinc core 4 surrounded by an adjacent electrode 6; however, in this case, the adjacent electrode is defined by a series of plates having an inner graphite plate 8 attached to a surface of a zinc plate 14 such that the graphite plate essentially shields the zinc from the core. Three plates have been placed about the core to generally surround the core 4, and each of the plates or segments are electrically connected. Interior to the adjacent electrode and exterior to this electrode is a gypsum bentonite mixture 20, and the electrode and bentonite mixture are retained within a porous cardboard container generally shown as 17. The adjacent electrode 6 need not be a circular ring, but merely needs to cooperate with the core and preferably generally surround the core to produce the additional potential.

Figure 4:
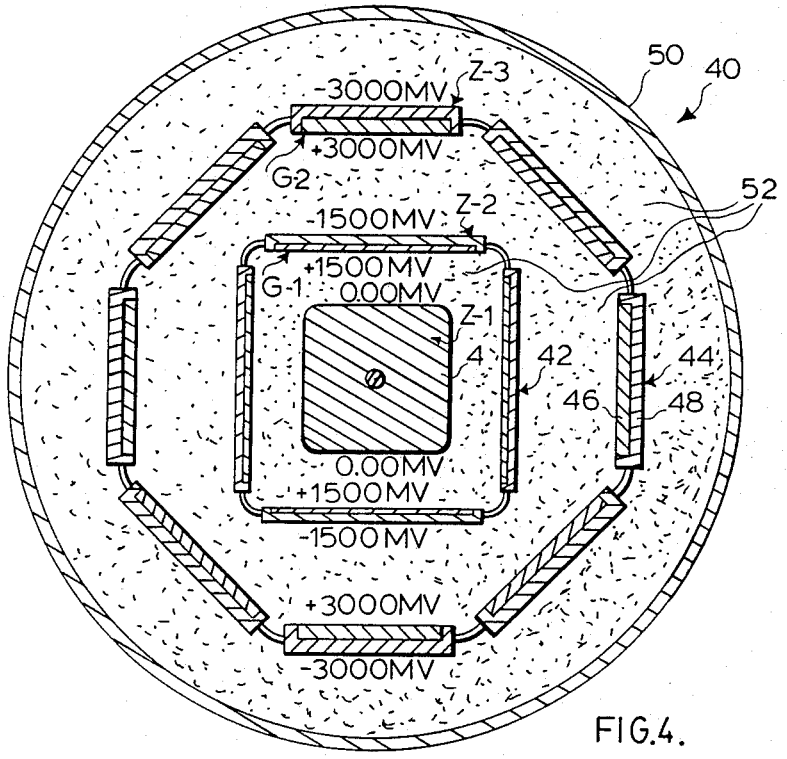
FIG. 4 is a cross-section of a further composite sacrificial anode having higher output.

A higher output zinc anode 40 is shown in FIG. 4 and includes a second ring-like anode 44 about the first ring anode 42, all of which surround core 4. Again, this ring-like anode is made of plates having an interior graphite layer 46 and an external layer of zinc 48 with a direct electrical connection between the graphite and zinc plate of each segment. This additional ring will result in a −3000 mv voltage potential relative to the zinc core. The anode is again surrounded by a cardboard container 50, and a mixture 52 of gypsum and bentonite is between the electrodes and between the core and the first electrode and exterior to the the outer ring of electrodes.

The output of up to −3000 mv is produced by the series of combined zinc graphite electrodes submerged in water or soil. The first ring of electrode segments cooperates with the core to produce +1500 mv. The polarity is reversed by the zinc to the exterior of that electrode and the process is repeated by the second ring of electrode segments. This results in the −3000 volt potential between the core and the outer zinc surface. Note that although the graphite and zinc are the preferred materials, other materials may be used and different materials can be mixed. The amount of current generated by the anode is a function of the outer surface resistance of the zinc anode, the voltage of the anode and the resistivity of the environment medium.

A regular zinc solid core anode has an output of −500 mv with respect to steel. The new high potential zinc anode has a −2400 mv potential to steel; an increase of about 5.1 over the regular zinc anode.

Aluminum may also be used to replace the zinc to produce a slightly lower output potential in the range of 1700 mv to 2400 mv with respect to steel. Magnesium would produce a higher output in the range of up to 3500 mv to steel. The output potentials of these high output sacrificial composite anodes are in the range of externally powered impressed current anodes and can be used to replace them. As in existing sacrificial anode applications, special low resistance back film material may be placed around the anode and electrodes which further improve the output. Such materials would include sodium sulphate, gypsum, bentonite mixtures.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A composite sacrificial anode comprising a core of a metal having a negative potential relative to steel, and an adjacent electrode, said adjacent electrode having a first substrate of a material having a positive potential relative to steel generally facing said core and a second substrate in direct electrical communication with said first substrate and of a material having negative potential relative to steel substantially shielded from said core by said first substrate having a positive potential relative to steel, said core including means for securing an electrical lead thereto, said anode including a suitable porous material between said core and said electrode which tends to retain water, said anode producing a potential voltage in the presence of an electrolyte between said core and electrode which is the collective effect of the material of said core and the materials of said electrode.

2. A composite sacrificial anode as claimed in claim 1, wherein said electrode is formed like a ring about said core.

3. A composite sacrificial anode as claimed in claim 2, wherein said electrode is made up of a series of connected segments spaced about said core.

4. A composite sacrificial anode as claimed in claim 3, including a further ring-like electrode about said adjacent electrode which cooperates therewith to increase the potential voltage of said anode.

5. A composite sacrificial anode as claimed in claim 4, wherein said ring-like electrode generally corresponds in structure to said adjacent electrode, but of greater size; said core, said adjacent electrode and said ring-like electrode being generally coaxial.

6. A composite sacrificial anode comprising a core of zinc or magnesium material surrounded by at least a first composite electrode having a first material with a surface facing said core of a material to create a first voltage potential between said core and said facing surface, said composite electrode including a second material in direct electrical connection with said first material and positioned relative to said first material to be shielded from said core by said first material and create a second voltage potential, said first material and said second material being selected to cooperate with said core such that an anode voltage potential between the core and the exterior surface of the electrode of a magnitude greater than either of said first and second voltage potentials is produced when an electrolyte interconnects said at least first composite electrode and said core.

7. A composite sacrificial anode as claimed in claim 6, wherein at least first and second composite electrodes cooperate with said core, said second composite electrode is exterior to said first electrode and shielded from said core by said first electrode, said second electrode comprising a first material facing said first electrode and selected to create a further increase in the anode voltage potential with this first material in direct electrical communication with a second material shielded from the core and said first electrode by first material and selected to further increase the magnitude of the voltage potential of the anode when said electrodes and core are connected with an electrolyte.

8. A composite anode as claimed in claim 7, wherein said electrodes are each formed in a ring-like shape generally coaxial with said core, and outwardly spaced from said core.

9. A composite anode as claimed in claim 8, wherein said electrodes are separated from each other and said core by a porous material which tends to retain water.

10. A composite anode as claimed in claim 9, wherein said porous material is a gypsum bentonite mixture.

11. A composite anode as claimed in claim 10, wherein said anode is elongate and said electrodes are generally coaxial about this longitudinal axis.

12. A composite sacrificial anode comprising a suitable core material which cooperates with an adjacent electrode means of a composite construction comprising a first material which cooperates with said core to provide an increase in the potential voltage between steel and zinc relative to zinc and the first material, said adjacent electrode means having a second material which cooperates with said first material and is directly electrically connected therewith, said second material being positioned relative to said core and said first material to be capable in the presence of an electrolyte of producing a potential voltage between said core and said second material relative to steel of the appropriate polarity and greater than the potential voltage of the core relative to steel.

13. A composite anode as claimed in claim 12, wherein said core is of a zinc material.

14. A composite anode as claimed in claim 12, wherein said core is of zinc and said first material is of graphite.

15. A composite anode as claimed in claim 13, wherein said second material is of zinc.

16. A composite anode as claimed in claim 12, wherein said first and second materials have abutting faces providing the direct electrical connection therebetween.

17. A composite anode as claimed in claim 16, wherein said electrode means has a number of connected segments, each segment including said first and second materials.

18. A composite anode as claimed in claim 17, wherein said electrode means is disposed in a ring form about and spaced from said core.

19. A composite anode as claimed in claim 18 including a second electrode means exterior to said adjacent electrode means, which is of a structure generally the same as said adjacent electrode means but of increased size, said second electrode means cooperating with said adjacent electrode means and said core to provide a further increase in the voltage potential of said anode.

* * * * *